US009822996B2

(12) United States Patent
Deng

(10) Patent No.: US 9,822,996 B2
(45) Date of Patent: Nov. 21, 2017

(54) ADDITIVE HEAT UNIT FOR HVAC HEAT PUMP SYSTEM

(71) Applicant: David Deng, Diamond Bar, CA (US)

(72) Inventor: David Deng, Diamond Bar, CA (US)

( * ) Notice: Subject to any disclaimer, the term of this patent is extended or adjusted under 35 U.S.C. 154(b) by 165 days.

(21) Appl. No.: 14/954,723

(22) Filed: Nov. 30, 2015

(65) Prior Publication Data

US 2016/0153687 A1 Jun. 2, 2016

Related U.S. Application Data

(60) Provisional application No. 62/086,090, filed on Dec. 1, 2014.

(51) Int. Cl.
*F25B 13/00* (2006.01)
*F25B 47/02* (2006.01)

(52) U.S. Cl.
CPC ..... *F25B 13/00* (2013.01); *F25B 47/02* (2013.01); *F25B 2313/004* (2013.01); *F25B 2313/0254* (2013.01); *F25B 2313/02521* (2013.01); *F25B 2313/02543* (2013.01); *F25B 2313/02742* (2013.01)

(58) Field of Classification Search
CPC ..... F25B 13/00; F25B 30/00; F25B 30/02; F25B 2313/004; F25B 2313/0252; F25B 2313/02521; F25B 2313/02522; F25B 2313/02523; F25B 2313/0254; F25B 2313/02543; F25B 2313/02742
USPC ..... 62/160, 197, 198
See application file for complete search history.

(56) References Cited

U.S. PATENT DOCUMENTS

| | | | |
|---|---|---|---|
| 4,100,763 | A | 7/1978 | Brody |
| 4,368,624 | A | 1/1983 | Takeshita |
| 4,645,908 | A | 2/1987 | Jones |
| 4,685,307 | A | 8/1987 | Jones |
| 4,809,516 | A | 3/1989 | Jones |
| 4,909,041 | A | 3/1990 | Jones |
| 5,101,639 | A | 4/1992 | Wruck et al. |
| 5,131,236 | A | 7/1992 | Wruck et al. |
| 5,133,193 | A | 7/1992 | Wruck et al. |
| 5,138,842 | A | 8/1992 | Wruck et al. |
| 5,170,635 | A | 12/1992 | Wruck et al. |
| 5,305,614 | A | 4/1994 | Gilles |
| 5,309,725 | A | 5/1994 | Cayce |
| 5,442,931 | A | 8/1995 | Ryan et al. |
| 6,589,111 | B1 | 7/2003 | Giroux |
| 6,758,054 | B2 | 7/2004 | Zheng et al. |

(Continued)

FOREIGN PATENT DOCUMENTS

| | | |
|---|---|---|
| DE | 3219277 | 12/1982 |
| EP | 2211127 | 7/2010 |

*Primary Examiner* — Marc Norman
(74) *Attorney, Agent, or Firm* — Middleton Reutlinger

(57) ABSTRACT

An additive heat transfer unit (AHTU) can be part of or added to an air source heat pump HVAC system. The heat pump system can include a compressor, an expansion valve, first and second air source heat exchangers, and a reversing valve. The system can have a cooling mode and a heating mode, such that in the cooling mode the first air source heat exchanger functions as an evaporator and the second air source heat exchanger functions as a condenser, this being reversed in the heating mode. The AHTU can include a liquid source heat exchanger that can be used to increase the efficiency of the system.

7 Claims, 12 Drawing Sheets

(56) References Cited

U.S. PATENT DOCUMENTS

| | | | | |
|---|---|---|---|---|
| 6,779,594 | B1 | 8/2004 | Judge et al. | |
| 7,753,105 | B2 | 7/2010 | Acre | |
| 7,836,707 | B2 | 11/2010 | Puranen et al. | |
| 7,954,336 | B2 | 6/2011 | Jacobi | |
| 8,437,877 | B2 | 5/2013 | Grohman et al. | |
| 8,470,071 | B2 | 6/2013 | Ehrenberg et al. | |
| 8,714,236 | B2 | 5/2014 | Karamanos | |
| 8,726,682 | B1 | 5/2014 | Olson | |
| 2006/0053821 | A1 | 3/2006 | Taras et al. | |
| 2009/0000318 | A1 | 1/2009 | Hart | |
| 2011/0079032 | A1 | 4/2011 | Taras et al. | |
| 2011/0154848 | A1 | 6/2011 | Jin | |
| 2012/0205077 | A1 | 8/2012 | Zinger et al. | |
| 2013/0118193 | A1 | 5/2013 | Nian et al. | |
| 2013/0167559 | A1* | 7/2013 | Kim | F25B 49/02 62/56 |
| 2014/0209086 | A1 | 7/2014 | Potter, Sr. et al. | |

* cited by examiner

HYBRID HEAT-PUMP/AC WITH PRIMARY WATER HEATING SYSTEM - ALTERNATE COIL

HYBRID HEAT-PUMP HVAC WITH ADDITIVE WATER HEAT SYSTEM

CONTROL PROCESS FLOW DIAGRAM

ADDITIVE HEAT UNIT FOR HVAC HEAT PUMP SYSTEM

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND OF THE INVENTION

Field of the Invention

Certain embodiments disclosed herein relate generally to heat pump systems. In particular, additive heat units and related methods of use are described that can be part of or added to heat pump systems. The heat pump systems can be used for HVAC, water heaters, as well as, for other uses.

Description of the Related Art

A heat pump is a device that provides heat energy from a source of heat or "heat sink" to a destination. Heat pumps are designed to move thermal energy opposite to the direction of spontaneous heat flow by absorbing heat from a cold space and releasing it to a warmer one. Heat pumps use a refrigerant as an intermediate fluid to absorb heat where it vaporizes, in the evaporator, and then to release heat where the refrigerant condenses, in the condenser.

SUMMARY OF THE INVENTION

There is in the need of the art for improved heat pumps, methods, and systems. For example, there is a need to increase the versatility of heat pumps for use in HVAC systems and/or water heaters in a broader range of climates, among other things.

An additive heat transfer unit (AHTU) can be part of or added to an air source heat pump HVAC system (e.g. a heat pump can be retrofitted with an AHTU). The heat pump system can include a compressor, an expansion valve, first and second air source heat exchangers, and a reversing valve. The system can have a cooling mode and a heating mode, such that in the cooling mode the first air source heat exchanger functions as an evaporator and the second air source heat exchanger functions as a condenser, this being reversed in the heating mode. The AHTU can include a liquid source heat exchanger that can be used to increase the efficiency of the system.

In some embodiments, the AHTU can include a liquid source heat exchanger and a directional bypass valve. The AHTU can define a parallel refrigerant flow path in a closed loop flow path between the expansion valve and the second air source heat exchanger. The directional bypass valve can be configured such that refrigerant flow bypasses the liquid source heat exchanger when the system is in the cooling mode. The AHTU can provide additional heat to the refrigerant either before or after the refrigerant flows to the second air source heat exchanger.

In some embodiments, an air source heat pump HVAC system can be provided, the system having a closed loop flow pathway configured for refrigerant to flow within the closed loop flow pathway. The system can comprise a compressor; an expansion valve; a first air source heat exchanger; a second air source heat exchanger; a reversing valve, and an additive heat transfer unit (AHTU). The reversing valve can have a first position in a cooling mode and a second position in a heating mode, and being configured to change a direction of flow of refrigerant through a closed loop flow pathway in the system such that in the cooling mode the first air source heat exchanger functions as an evaporator and the second air source heat exchanger functions as a condenser, and in a heating mode the first air source heat exchanger functions as a condenser and the second air source heat exchanger functions as an evaporator. The reversing valve can include any number of valves to control one or more flow paths such as one, two, three, or four valves.

The closed loop flow path can define a refrigerant flow path in a continuous loop, such that when the reversing valve is in the first position in a cool mode, the refrigerant flow path extends from the compressor to the second air source heat exchanger, from the second air source heat exchanger to the expansion valve, from the expansion valve to the first air source heat exchanger, and from the first air source heat exchanger back to the compressor, the refrigerant flow path being reversible when the reversing valve is moved to the second position.

An additive heat transfer unit (AHTU) can comprise a liquid source heat exchanger; and a directional bypass valve configured such that refrigerant flow bypasses the liquid source heat exchanger when the system is in the cooling mode. The AHTU can define a parallel refrigerant flow path in the closed loop flow path between the expansion valve and the second air source heat exchanger when the system is in the heating mode, the AHTU can be configure to provide additional heat to the refrigerant either before or after the refrigerant flows to the second air source heat exchanger.

In some embodiments, an additive heat transfer unit (AHTU) can be provided for retrofitting an air source heat pump HVAC system. The system can have a closed loop flow pathway configured for refrigerant to flow within the closed loop flow pathway. The AHTU can comprise a liquid source heat exchanger; and a directional bypass valve configured such that refrigerant flow bypasses the liquid source heat exchanger when an air source heat pump HVAC system that the AHTU is connect to is in the cooling mode; wherein the AHTU defines a parallel refrigerant flow path in a closed loop flow path between an expansion valve and a second air source heat exchanger in the air source heat pump HVAC system when the system is in the heating mode, the AHTU configured to provide additional heat to the refrigerant either before or after the refrigerant flows to the second air source heat exchanger.

In some embodiments, an air source heat pump system can have a closed loop flow pathway configured for refrigerant to flow within the closed loop flow pathway. The system can comprise a compressor; an expansion valve; a first air source heat exchanger; a second air source heat exchanger; and an additive heat transfer unit (AHTU). The system can have a closed loop flow path that defines a refrigerant flow path in a continuous loop such that in a heating mode the first air source heat exchanger functions as a condenser and the second air source heat exchanger functions as an evaporator, the refrigerant flow path extends from the compressor to the first air source heat exchanger, from the first air source heat exchanger to the expansion valve, from the expansion valve to the second air source heat exchanger, and from the second air source heat exchanger back to the compressor. The additive heat transfer unit (AHTU) can comprise a liquid source heat exchanger, wherein the AHTU defines a parallel refrigerant flow path in the closed loop flow path between the expansion valve and the second air source heat exchanger when the system is in the heating mode, the AHTU configured to provide additional heat to the refrigerant either before or after the refrigerant flows to the second air source heat exchanger.

In some embodiments, an air source heat pump HVAC system can have a closed loop flow pathway configured for refrigerant to flow within the closed loop flow pathway. The system can comprise a compressor; an expansion valve; a first air source heat exchanger; a second air source heat exchanger; a reversing valve; an additive heat transfer unit (AHTU); a water heater; a water heater coil; and a heat transfer coil.

The reversing valve having a first position in a cooling mode and a second position in a heating mode, and being configured to change a direction of flow of refrigerant through a closed loop flow pathway in the system such that in the cooling mode the first air source heat exchanger functions as an evaporator and the second air source heat exchanger functions as a condenser, and in a heating mode the first air source heat exchanger functions as a condenser and the second air source heat exchanger functions as an evaporator.

The closed loop flow path defines a refrigerant flow path in a continuous loop, such that when the reversing valve is in the first position in a cool mode, the refrigerant flow path extends from the compressor to the second air source heat exchanger, from the second air source heat exchanger to the expansion valve, from the expansion valve to the first air source heat exchanger, and from the first air source heat exchanger back to the compressor, the refrigerant flow path being reversible when the reversing valve is moved to the second position.

The additive heat transfer unit (AHTU) can comprise a liquid source heat exchanger, wherein the flow of refrigerant passes through the AHTU in both the cooling and heating modes, the AHTU configured to provide additional heat to the refrigerant either before or after the refrigerant flows to the second air source heat exchanger. The water heater coil can be in thermal communication with the water heater and the AHTU and configured such that excess heat from the AHTU can be used to heat water from the water heater. The heat transfer coil can be positioned within the second air source heat exchanger, the heat transfer coil can be configured to such that liquid from the liquid source heat exchanger in the AHTU is directed to the second air source heat exchanger during a defrost cycle during the heating mode.

BRIEF DESCRIPTION OF THE DRAWINGS

Various embodiments are depicted in the accompanying drawings for illustrative purposes, and should in no way be interpreted as limiting the scope of the inventions, in which like reference characters denote corresponding features consistently throughout similar embodiments.

DETAILED DESCRIPTION

Figure 1:
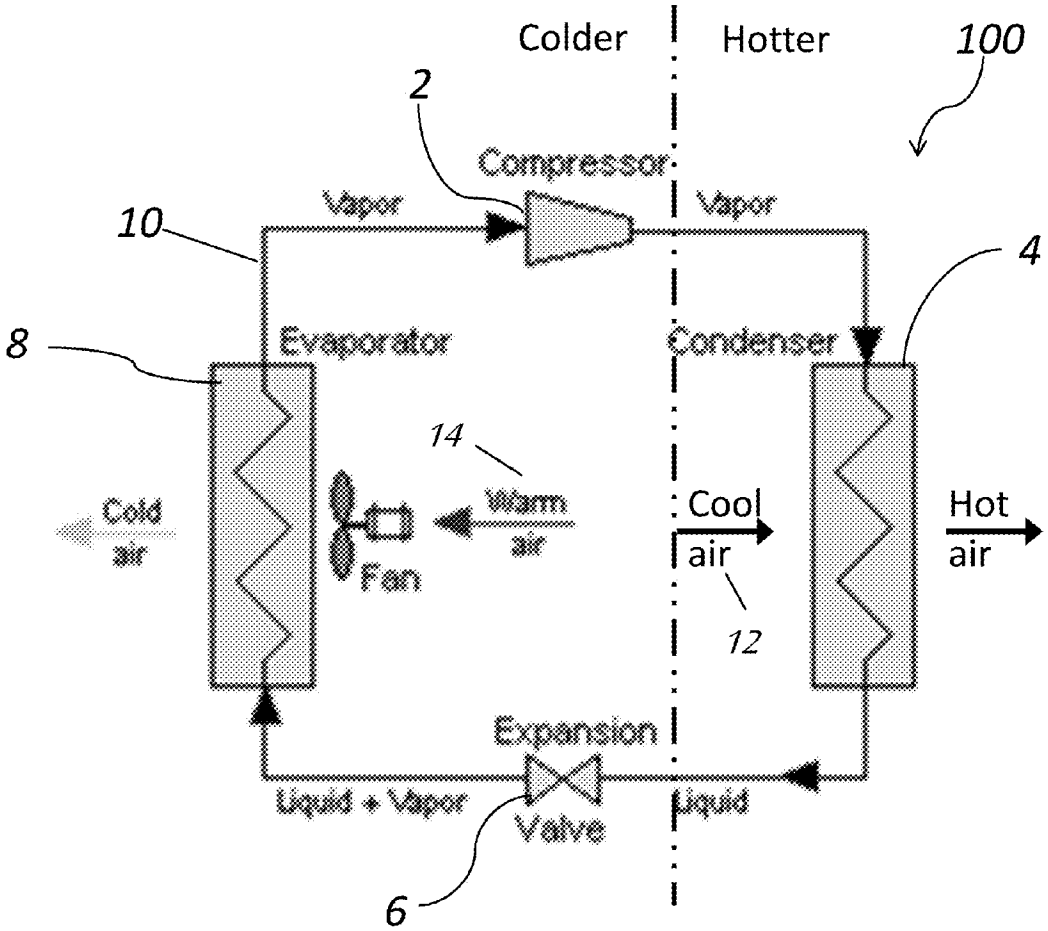
FIG. 1 is a schematic view of a heat pump system.

Vapor-compression refrigeration is one of the many types of refrigeration cycles and is the widely used for air-conditioning of buildings and automobiles. A heat pump using vapor-compression has a circulating working fluid or refrigerant which absorbs and removes heat from the space to be cooled and subsequently rejects that heat elsewhere. FIG. 1 depicts a simplified heat pump 100 with a typical vapor-compression system. The heat pump 100 has four basic components, a compressor 2, a condenser 4, a thermal expansion valve 6 (also called a throttle valve or metering device), and an evaporator 8. The condenser 4 and evaporator 8 are both types of heat exchangers.

Refrigerant 10 is positioned within a closed loop system of various pipes, coils, etc. and is run through the above mentioned components. The following is a description of a typical vapor-compression system. The refrigerant 10, in its gaseous or vapor state, is pressurized and circulated through the system by the compressor 2. After flowing through the compressor 2, the refrigerant 10 is a hot and highly pressurized vapor that is then cooled in the condenser 4. The condenser 4 is a heat exchanger where hot vapor is cooled and condensed into a liquid as it flows through a coil or tubes with a cool medium 12 (such as air or water) flowing across the coil or tubes. The refrigerant 10 transfers heat from the system to the air or water 12 flowing over the coil or tubes. This condenses the refrigerant 10 into a high pressure, moderate temperature liquid.

The condensed refrigerant then passes through the metering device 6. The metering device 6 is a pressure-lowering device which can be an expansion valve, capillary tube, or work-extracting device such as a turbine. Pressure reduction evaporates some of the liquid refrigerant 10 and lowers the temperature of the liquid and vapor refrigerant mixture. The refrigerant 10 should now be colder than the temperature of the enclosed space to be refrigerated, when the system is used for cooling.

The low pressure and cold refrigerant mixture 10 is then routed through a coil or tubes in the evaporator 8. A warm medium 14 flowing over the coil or tubes evaporates the liquid part of the cold refrigerant mixture 10. This results in the system absorbing heat and cooling the warm medium. For example, a fan may circulate warm air in an enclosed space across the coil or tubes carrying the cold refrigerant liquid and vapor mixture. The warm circulating air is cooled to lower the temperature of the enclosed space.

After flowing through the evaporator 8, the refrigerant 10 returns to the compressor 2 and the cycle is repeated. In summary, heat pumps are generally used to absorb heat in the evaporator 8, and release heat in the condenser 4.

In the above discussion and throughout the application it will be understood that the terms cool, hot, cold, warm, etc. are all relative terms and do not necessarily infer an absolute temperature.

In HVAC applications, a heat pump is typically a vapor-compression refrigeration device that includes a reversing valve and optimized heat exchangers so that the direction of heat flow (thermal energy movement) may be reversed. The reversing valve can switch the direction of refrigerant through the cycle and therefore the heat pump may deliver either heating or cooling to a building. The condenser and evaporator are both types of heat exchangers. In some embodiments they are the same types of heat exchangers and can be reversed so that in one mode the heat exchanger functions as a condenser and in a second mode it functions as an evaporator.

Figure 2:
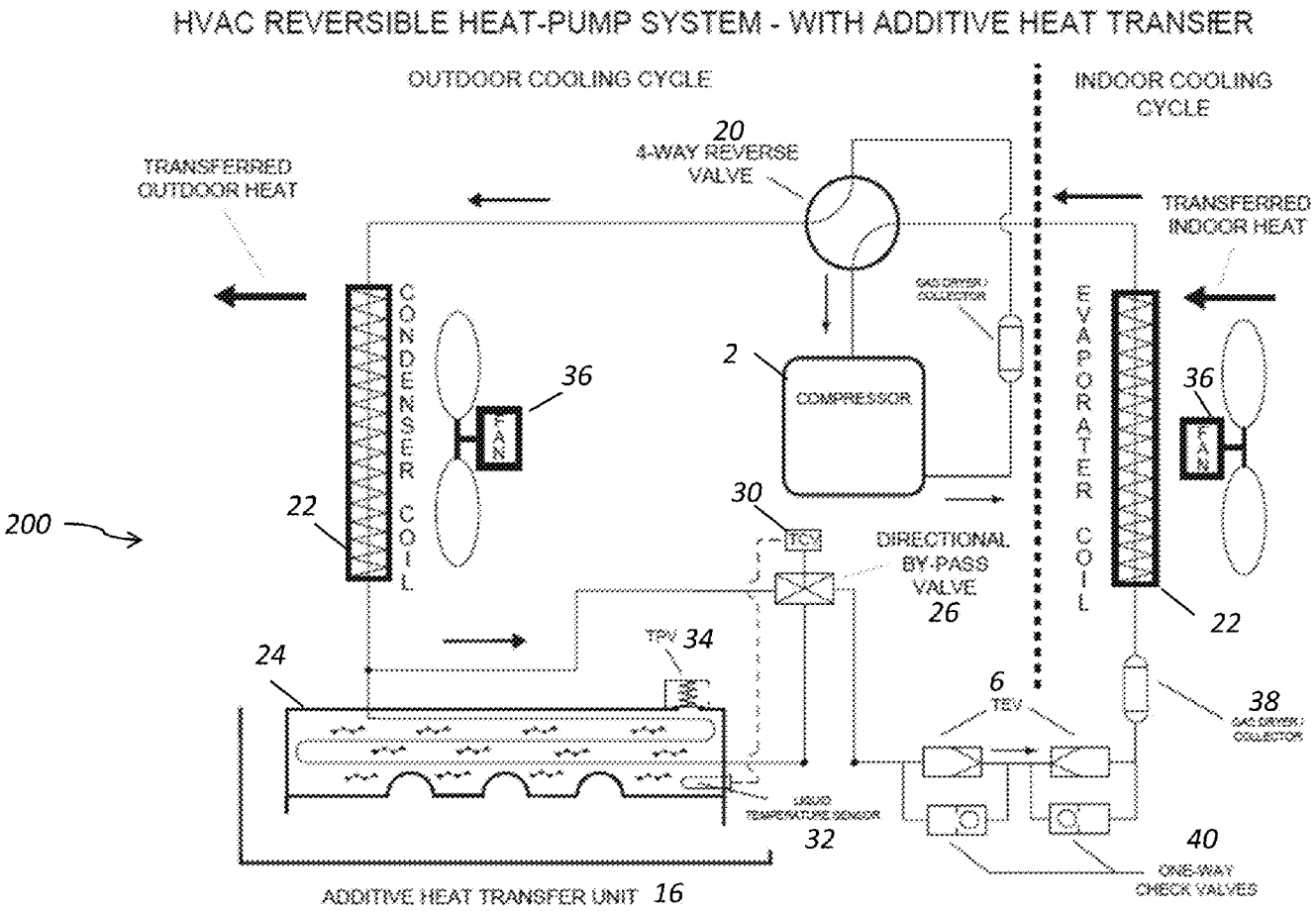
FIG. 2 is a schematic view of a heat pump system in a cooling mode.
Figure 3:
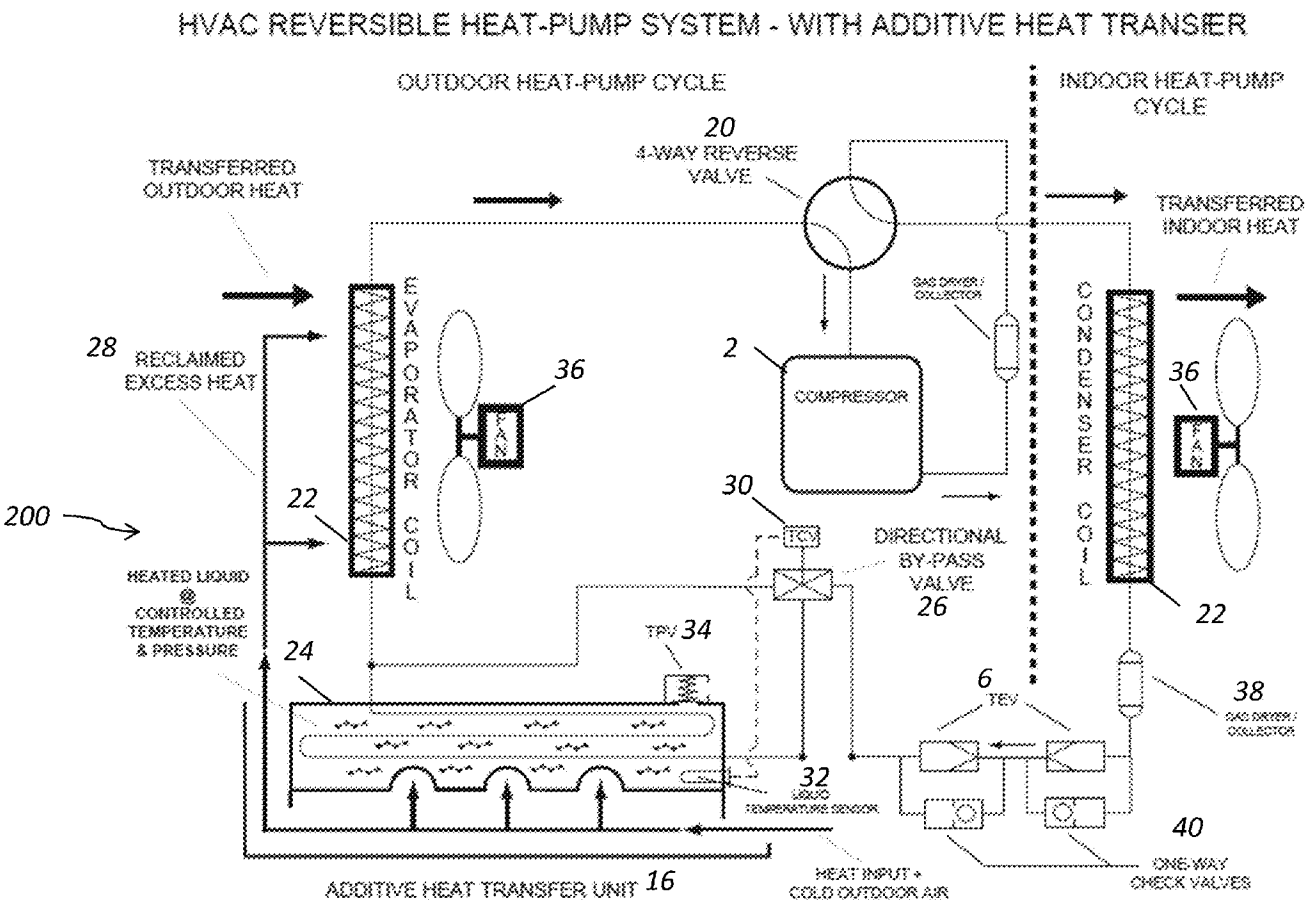
FIG. 3 is a schematic view of the heat pump system of FIG. 2 in a heating mode.

Looking now at FIGS. 2 and 3, a heat pump 200 with a reversing valve 20 is shown. The system 200 can function similar the heat pump 100 above, but can also be reversed. Thus, the heat exchanges 22 can function as both a condenser and an evaporator, depending on the selected mode and the flow of the refrigerant through the system. FIG. 2 illustrates the system in a cooling mode and FIG. 3 shows the system in a heating mode. The heat pump 200 is illustrate as an air source heat pump, but can also be a water source (geo thermal or other source) heat pump.

An additive heat transfer unit 16 is also shown in FIGS. 2 and 3. The additive heat transfer unit 16 can include a third heat exchanger 24, and in some embodiments, a directional by-pass valve 26, among other things. The directional by-pass valve 26 and third heat exchanger 24 can be configured such that the flow of refrigerant bypasses the third heat exchanger 24 when the system is in the cooling mode (FIG. 2). But, when in the heating mode, the system can selectively allow some or all of the flow of refrigerant to flow to the third heat exchanger 24. This flow can be heated by the third heat exchanger 24. Thus, the third heat exchanger can provide supplemental heating when needed.

To function properly, a heat pump needs to fluctuate between temperatures that are greater than the temperature difference between the inside (area being air conditioned) and the outside. Thus in heating mode, it needs to be able to heat the refrigerant to be hotter than the temperature inside and cool the refrigerant to be colder than the temperature outside. This can lead to problems when the temperature outside gets very cold. In particular, the evaporator coil, outside in the cold, can develop ice build-up on the outside of the evaporator. This ice build-up can cause the system to not heat up sufficiently to be able to provide heating for the inside. To combat this problem, the typical response has been to reverse the system so that outside heat exchanger becomes a condenser and generates heat to melt the ice. But, this also means that the system is now working to cool down the inside area that it is desired to heat.

The colder it is outside, the more ice build-up and the more frequent the system must be reversed, cooling down the inside as well. Thus, heat pump systems are not typically used in areas that experience large temperature fluctuations between summer and winter. For example, in the United States, such systems are not typically used in northern Michigan or Wisconsin, but they are more common in areas of North Carolina. An additive heat transfer unit 16 can be used to overcome certain of these drawbacks and allow the heat pump HVAC system to be used in more varied climes.

As shown in FIGS. 2 and 3, an additive heat transfer unit 16 is added to a heat pump style HVAC system. Thus, the heat exchanger coils can be used to evaporate or condense, depending on whether heating or cooling is desired. The bypass valve 26 allows the system to function as a normal system and can only kick in the additive heat transfer unit when needed.

The additive heat transfer unit 16 can be used when heating and even then may only be used when needed, for example, when the outside conditions are colder than usual. The additive heat transfer unit 16 uses a heat source (e.g. gas heater, electric heater, etc., represented by three vertical arrows) to heat a liquid (e.g. water with anti-freeze). The refrigerant of the heat pump system travels through a series of pipes immersed in the heated liquid which transfers heat to the refrigerant. This preheats the refrigerant prior to further heating in the evaporator coil (left side 22 in FIG. 3). In other embodiments, the refrigerant can be further heated by the additive heat transfer unit after it has passed through the evaporator coil. In addition, exhaust 28 from heating the additive heat transfer unit can be directed at the evaporator coil to increase efficiency during evaporation.

Heat pump systems are often more energy efficient than other types of HVAC systems. But, as explained above, they are not usually used in the some climes because they have not typically performed well in very cold (sub 0° F.) temperatures. In some instances, an auxiliary heater may be included inside a building to directly heat the air when the heat pump system is defrosting. The auxiliary heater will generally provide heating directly to the air, such as a gas or electric heater, and decreases the energy efficiency of the overall system.

As shown in FIG. 3, the additive heat transfer unit 16 can be located outside the building (wall represented by dashed line) and can heat the refrigerant directly to better take advantage of heating efficiencies. In addition, in some embodiments, exhaust air 28 from the additive heat transfer unit 16 can be directed to the evaporator coil 22 to further increase energy efficiency.

The additive heat transfer unit 16 can include a third heat exchanger 24 comprising a coil submersed in liquid, as shown. The additive heat transfer unit 16 can heat the liquid which liquid can then transfer the heat to the refrigerant. The heat source can be one or more of among many different types, such as a gas heater (including dual fuel) and an electric heater.

A temperature control valve (TCV) 30 can be used to control the directional by-pass valve 26 to meter the desired amount of refrigerant to the third heat exchanger 24. The TCV 30 can have one or more temperature sensors 32 in the third heat exchanger and/or elsewhere in the system. The TCV can control the bypass valve, and possibly other valves as well, at least in part based on the sensed temperature of the one or more temperature sensors.

The directional by-pass valve 26 and third heat exchanger 24 can be configured such that the flow of refrigerant bypasses the third heat exchanger 24 when the system is in the cooling mode (FIG. 2). But, when in the heating mode, the system can selectively allow some or all of the flow of refrigerant to flow to the third heat exchanger. This flow can be heated by the third heat exchanger. The TCV can also control other valves according to certain embodiments.

The third heat exchanger can include a TPV (temperature pressure valve) 34. The TPV can be a safety valve set for passive control, such to provide pressure relief at and above 150 psi and 200 F (or other pressures and temperatures).

The system 200 can also include one or more of the following a fan 36 (two shown), a gas dryer/collector 38 (two shown), and a one-way check valve 40 (two shown). The gas dryer/collector can provide filtering in the system. The one-way check valves can have one for cooling and one for heating. The one-way check valves can be tuned to the system, and in some embodiments can be modulated, such as with the TCV. The one-way check valves can be positioned in parallel with the thermal expansion valve (TEV) 6. In particular, two one-way TEV valves can be positioned each in parallel with an accompanying by-pass or in line check valve at different points in the system. Alternatively a single in-line, bi-flow type TEV valve being bi-directional can be employed at a single point in the system. These two methods may be used depending on the system size and need for optimizing the expansion rate and flow of lubricant through the system, among other considerations. It will be understood that other types of TEV systems can also be used.

In the illustrated embodiments, there is preferably only one compressor 2 per embodiment, though additional compressors can be used.

Figure 4:
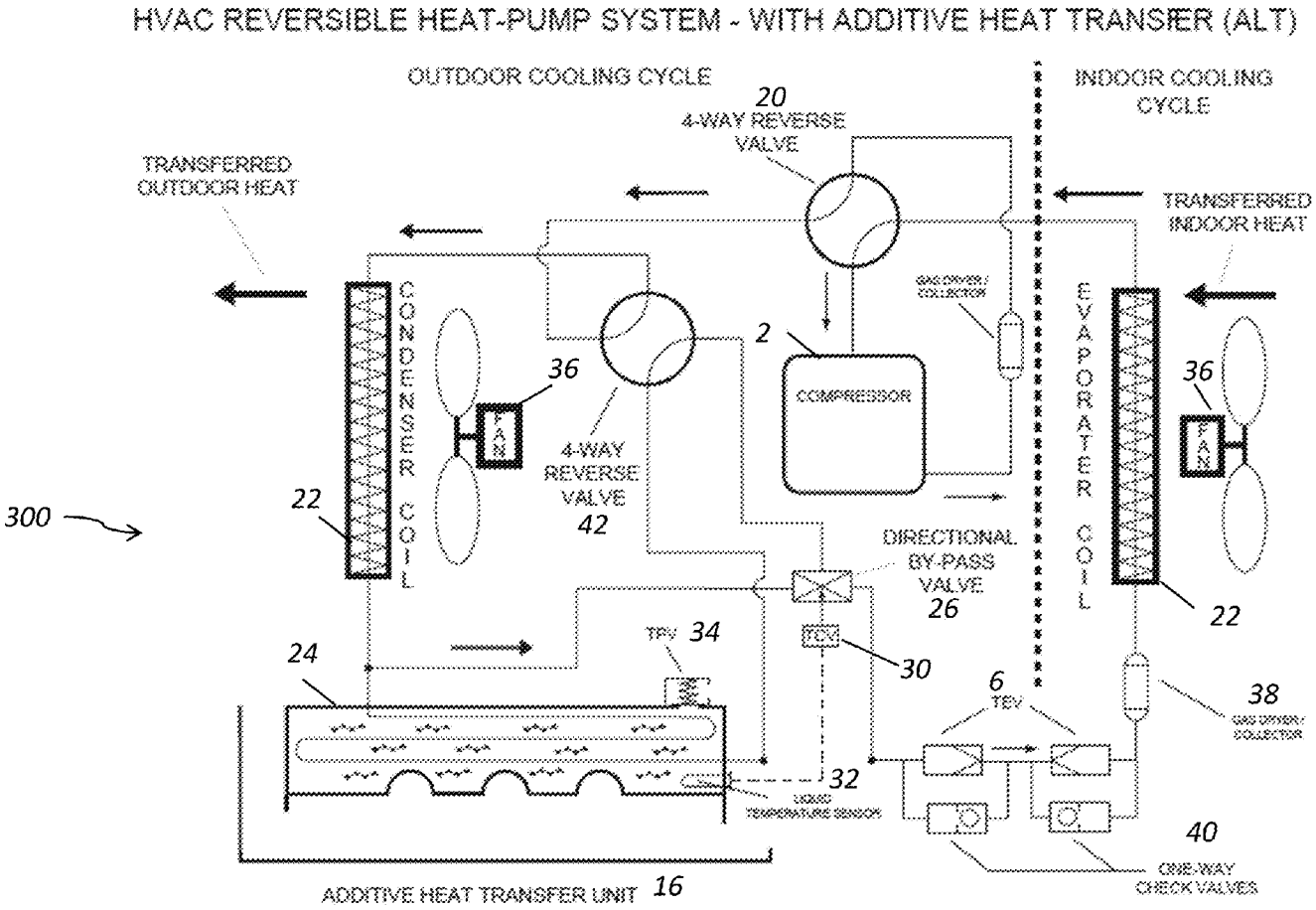
FIG. 4 is a schematic view of a heat pump system in a cooling mode.
Figure 5:
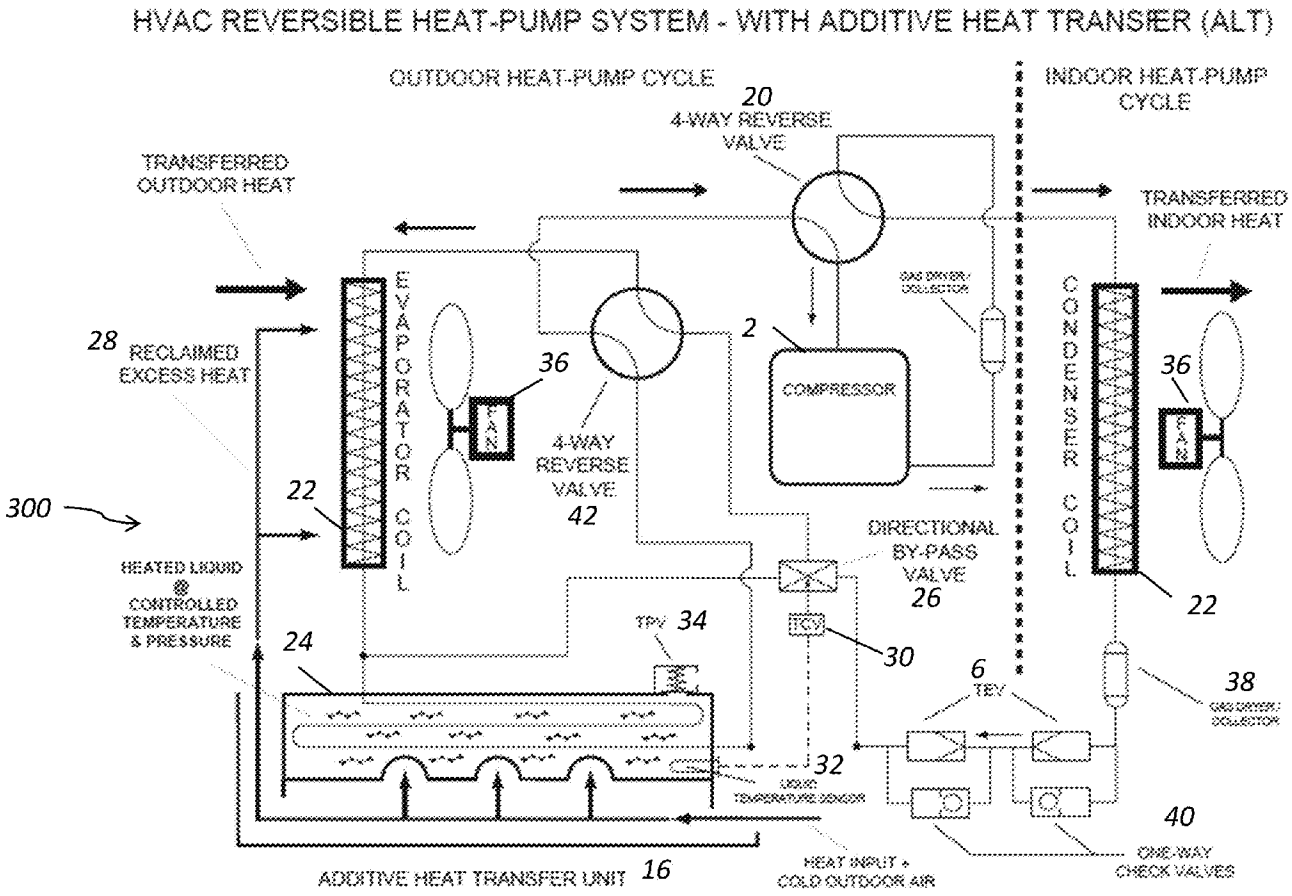
FIG. 5 is a schematic view of the heat pump system of FIG. 4 in a heating mode.
Figure 6:
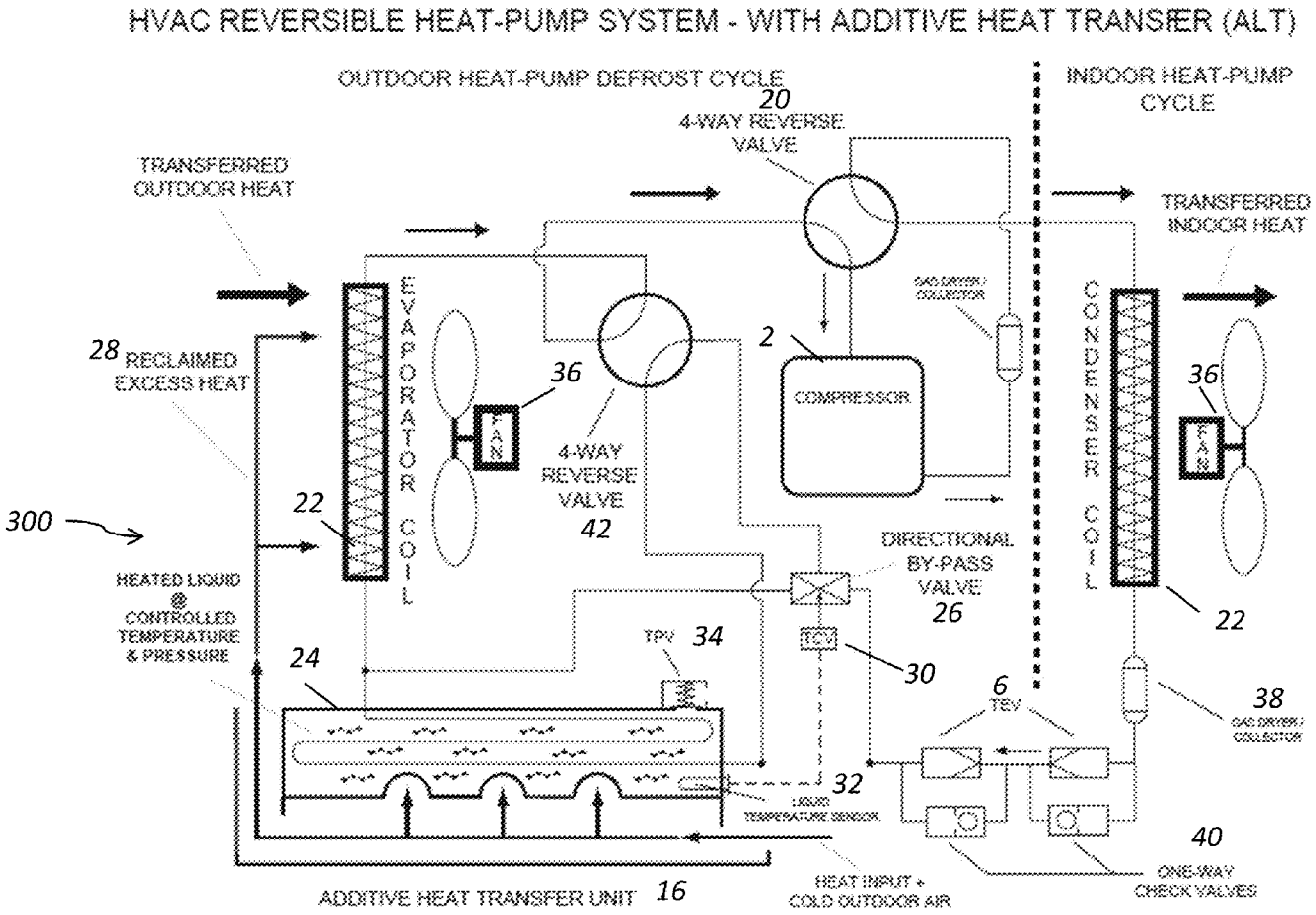
FIG. 6 is a schematic view of the heat pump system of FIG. 4 in a defrost mode.

Looking now to FIGS. 4-6, another embodiment of heat pump 300 with additive heat transfer unit 16 is shown. In this embodiment, many of the components are the same or substantially similar to previously-described components. However, as emphasized repeatedly herein, these features need not be present in all embodiments.

In this embodiment, a second reversing valve 42 is included in the system. In the indoor cooling cycle of FIG. 4, the system 300 can perform in essentially the same way as the system 200 (FIG. 2). But, in the indoor heat cycle the second reversing valve 42 can change the flow so that the additive heat transfer unit can be used to heat the refrigerant after evaporation, but before it goes to the compressor (FIG. 5) or it can be used in a defrost mode (FIG. 6) to heat the refrigerant before it reaches the evaporator coil. Comparing FIGS. 5 and 6, it can be seen that the second reversing valve 42 is moved from a first position (FIG. 5, also FIG. 4) to a second position (FIG. 6).

Figure 7:
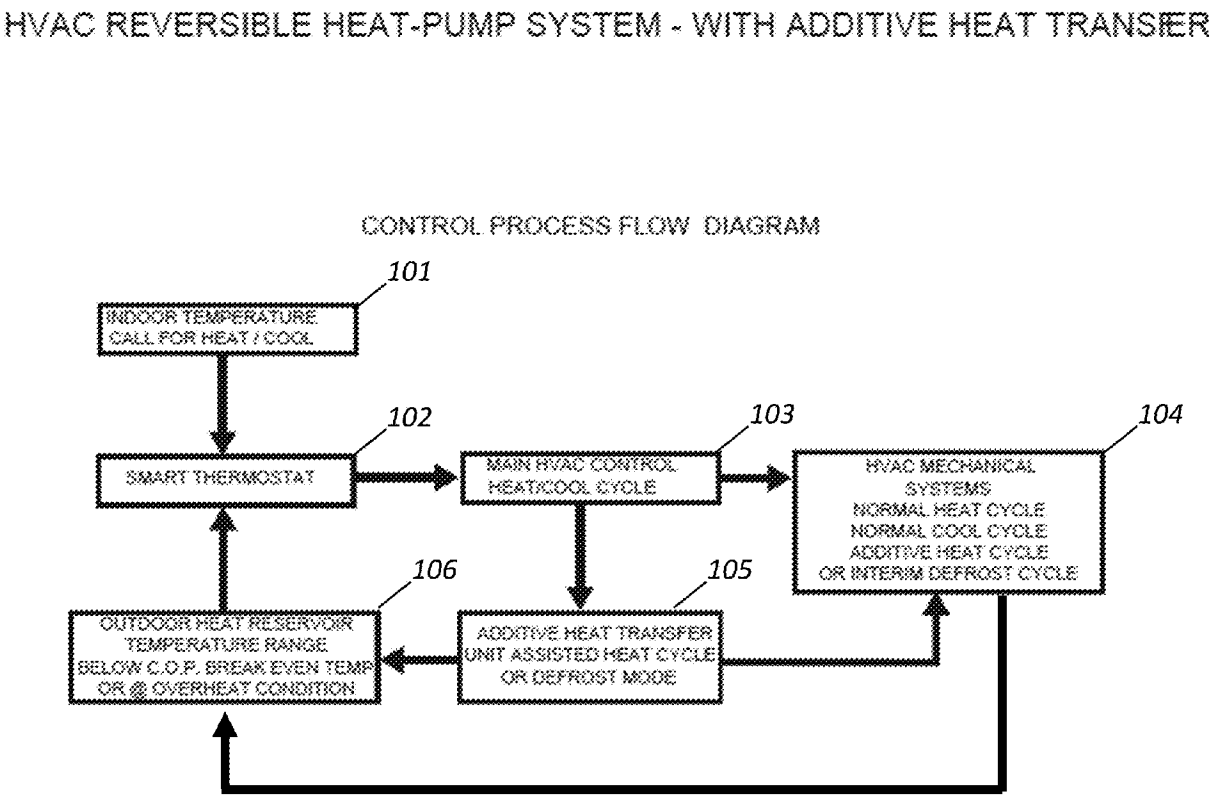
FIG. 7 illustrates a control process flow diagram.

Looking now to FIG. 7, a control process flow diagram is shown. The control process flow diagram illustrates a control process that can be used to modulate one or more of the components. For example, the control process flow diagram can modulate fan speed, defrost mode, additive heat, refrigerant flow, refrigerant metering (at the directional by-pass valve or a one-way check valve), etc. The control process flow can be used with any of the embodiments described herein. In some embodiments, the control process flow may make the second 4-way valve unnecessary, as it can modulate any of the components, fan speed, defrost additive heat, etc. as needed.

The control process can start at 101 with the call for heating or cooling. This can be such as when the system is turned on, and/or when the heater or AC is turned on. The process then moves to 102 wherein one or more ambient temperatures are compared to a desired temperature. The system can then determine whether a heating or a cooling cycle is warranted at 103. The system then communicates with the main HVAC system 104 and/or the additive heat transfer system 105 to provide the correct amount of heating and/or cooling. At 104 the HVAC system runs the particular desired cycle, for example, a normal cooling cycle, a normal heating cycle, an additive heating cycle, or a defrost cycle. The system can then loop back to 102 to monitor the temperature and turn the system off or adjust the level of heating or cooling. A system check 106 can also be performed in the system to ensure that the system is running efficiently and safely.

It will be understood that the additive heat transfer unit can be a standalone unit that can be used to retrofit an existing HVAC system, such as a home HVAC system, and in particular an air source heat pump system with a compressor, expansion valve, and two heat exchangers. The additive heat transfer unit and/or the entire heat pump system can be self-contained systems and "off-the-shelf" systems that do not need other than minor customization to be installed in a house.

In some embodiments, an air source heat pump HVAC system can be provided, the system having a closed loop flow pathway configured for refrigerant to flow within the closed loop flow pathway. The system can comprise a compressor; an expansion valve; a first air source heat exchanger; a second air source heat exchanger; a reversing valve, and an additive heat transfer unit (AHTU). The reversing valve can have a first position in a cooling mode and a second position in a heating mode, and being configured to change a direction of flow of refrigerant through a closed loop flow pathway in the system such that in the cooling mode the first air source heat exchanger functions as an evaporator and the second air source heat exchanger functions as a condenser, and in a heating mode the first air source heat exchanger functions as a condenser and the second air source heat exchanger functions as an evaporator. The reversing valve can include any number of valves to control one or more flow paths such as one, two, three, or four valves.

The closed loop flow path can define a refrigerant flow path in a continuous loop, such that when the reversing valve is in the first position in a cool mode, the refrigerant flow path extends from the compressor to the second air source heat exchanger, from the second air source heat exchanger to the expansion valve, from the expansion valve to the first air source heat exchanger, and from the first air source heat exchanger back to the compressor, the refrigerant flow path being reversible when the reversing valve is moved to the second position.

An additive heat transfer unit (AHTU) can comprise a liquid source heat exchanger; and a directional bypass valve configured such that refrigerant flow bypasses the liquid source heat exchanger when the system is in the cooling mode. The AHTU can define a parallel refrigerant flow path in the closed loop flow path between the expansion valve and the second air source heat exchanger when the system is in the heating mode, the AHTU can be configure to provide additional heat to the refrigerant either before or after the refrigerant flows to the second air source heat exchanger.

In some embodiments, an additive heat transfer unit (AHTU) can be provided for retrofitting an air source heat pump HVAC system. The system can have a closed loop flow pathway configured for refrigerant to flow within the closed loop flow pathway. The AHTU can comprise a liquid source heat exchanger; and a directional bypass valve configured such that refrigerant flow bypasses the liquid source heat exchanger when an air source heat pump HVAC system that the AHTU is connect to is in the cooling mode; wherein the AHTU defines a parallel refrigerant flow path in a closed loop flow path between an expansion valve and a second air source heat exchanger in the air source heat pump HVAC system when the system is in the heating mode, the AHTU configured to provide additional heat to the refrigerant either before or after the refrigerant flows to the second air source heat exchanger.

In some embodiments, an air source heat pump system can have a closed loop flow pathway configured for refrigerant to flow within the closed loop flow pathway. The system can comprise a compressor; an expansion valve; a first air source heat exchanger; a second air source heat exchanger; and an additive heat transfer unit (AHTU). The system can have a closed loop flow path that defines a refrigerant flow path in a continuous loop such that in a heating mode the first air source heat exchanger functions as a condenser and the second air source heat exchanger functions as an evaporator, the refrigerant flow path extends from the compressor to the first air source heat exchanger, from the first air source heat exchanger to the expansion valve, from the expansion valve to the second air source heat exchanger, and from the second air source heat exchanger back to the compressor. The additive heat transfer unit (AHTU) can comprise a liquid source heat exchanger, wherein the AHTU defines a parallel refrigerant flow path in the closed loop flow path between the expansion valve and the second air source heat exchanger when the system is in the heating mode, the AHTU configured to provide additional heat to the refrigerant either before or after the refrigerant flows to the second air source heat exchanger.

Figure 8:
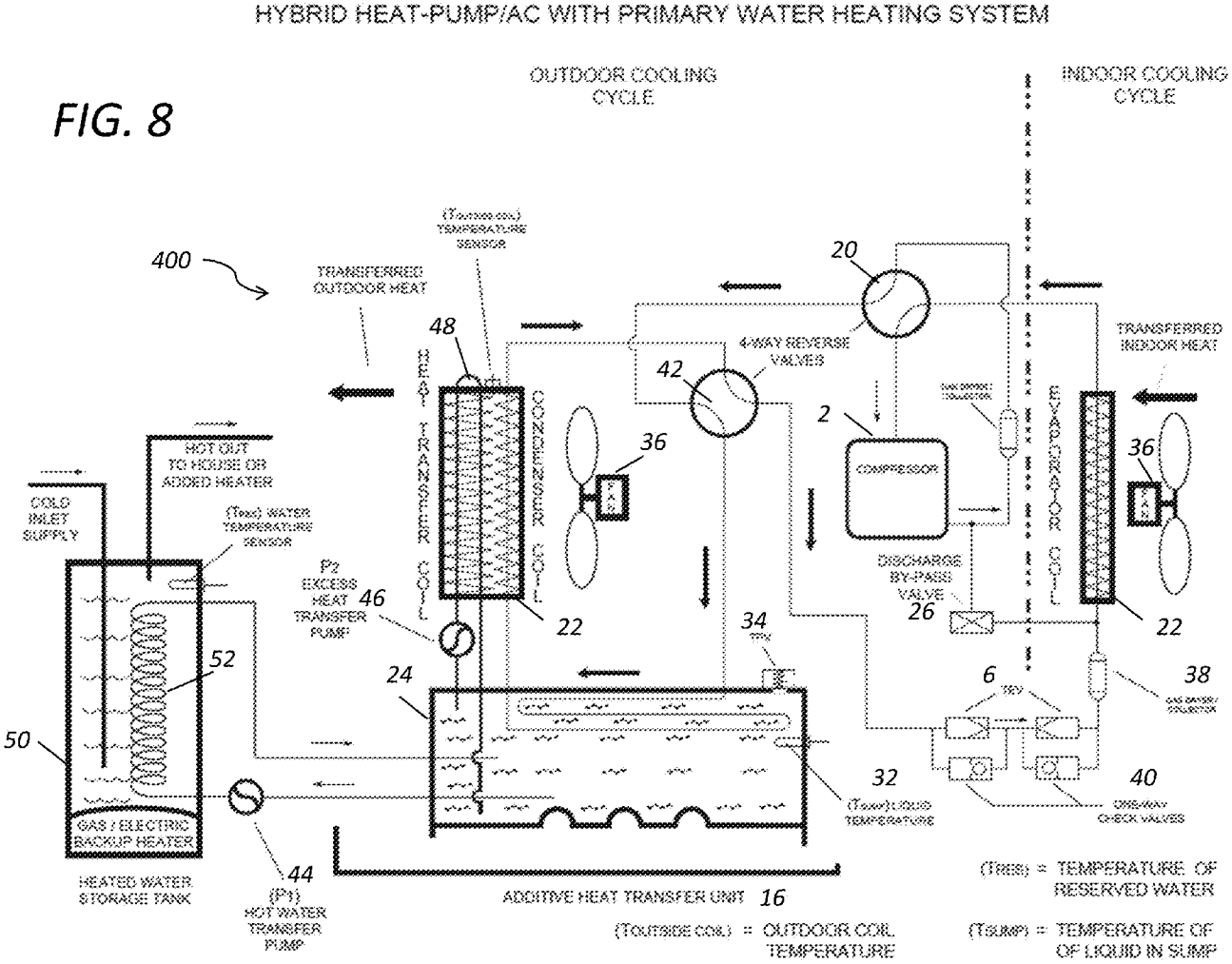
FIG. 8 shows a schematic view of another heat pump system in a cooling mode.
Figure 9:
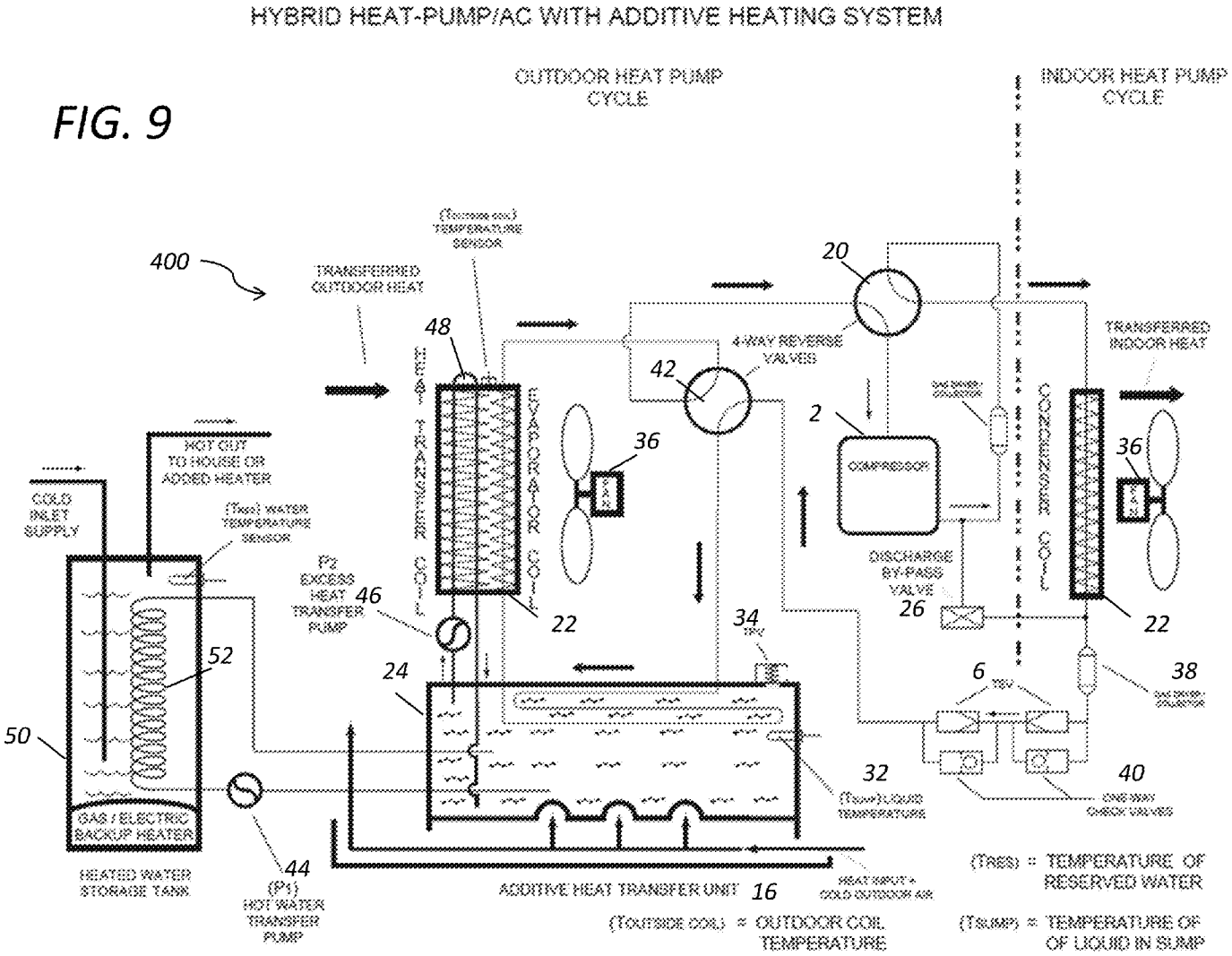
FIG. 9 is the heat pump system of FIG. 8 in a heating mode.

Turning now to FIGS. 8 and 9, another embodiment of heat pump 400 is shown. The heat pump 400 has been integrated into a water heater with storage tank 50. Integrating the water heater 50 and heat pump 400 can allow the water heater to take advantage of the heat from the HVAC system. In particular, excess heat from the heat pump can be transferred to the water in the water heater storage tank 50. This can reduce the amount of heat and energy needed to be expended to heat the water in the water heater. As shown a coil 52 and pump 44 can be used to direct liquid from the additive heat transfer unit to the water heater 50. Thus, the liquid can leave the water heater 50/coil 52 at a cooler temperature than when it entered the water heater 50/coil 52. The system can monitor and compare the temperatures of the water heater ($T_{RES}$) and the additive heat transfer unit ($T_{SUMP}$). For example, when $T_{RES}$ is less than $T_{SUMP}$, the pump 44 can be activated to transfer some of the heat to the water in the water heater.

Figure 10:
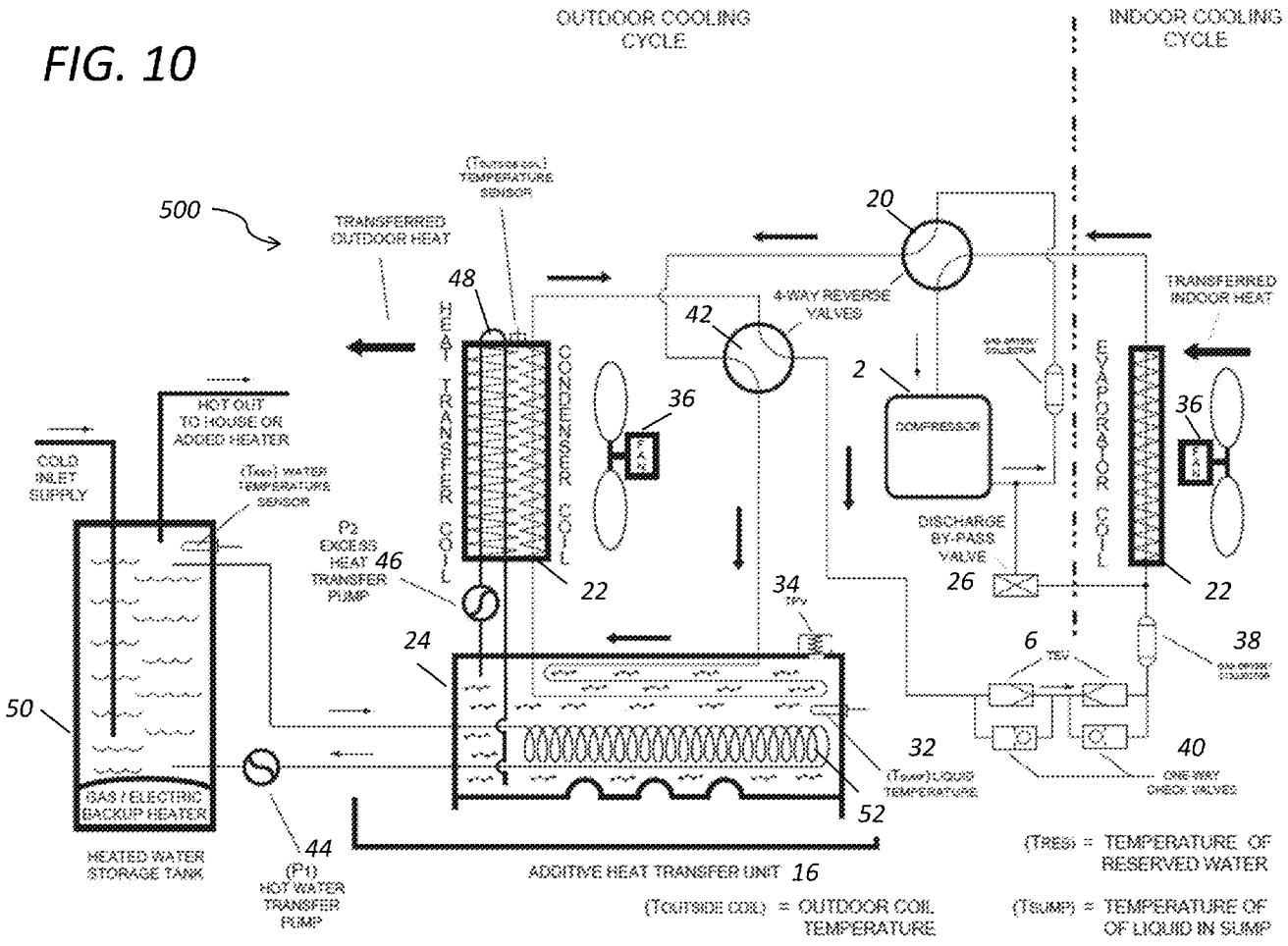
FIG. 10 shows a schematic view of another heat pump system in a cooling mode.

FIG. 10 shows an alternative heat pump 500 where the coil 52 is positioned within the additive heat transfer unit 16 instead of the water heater 50. In climates that don't get too cold, portable water can flow from the water heater to be heated within the additive heat transfer unit. This would be preferable in climates that do not need freeze protected fluids.

The water heating feature of the additive heat transfer unit can be used in either a cooling or a heating mode, but would most likely be used in the cooling mode shown in FIG. 8. Lowering the temperature of the liquid in the additive heat transfer also reduces the amount of work needed to condense the refrigerant at the condenser coil 22 during the cooling mode.

Turning to FIG. 9, it can be seen that excess heat from the additive heat transfer unit can also be transferred to the heat exchanger 22 functioning as an evaporator. A heat transfer coil 48 can be positioned in the heat exchanger 22. The heat transfer coil 48 can heat air flowing to the evaporator coil. The heat transfer coil 48 can be used to defrost the heat exchanger 22.

Figure 11:
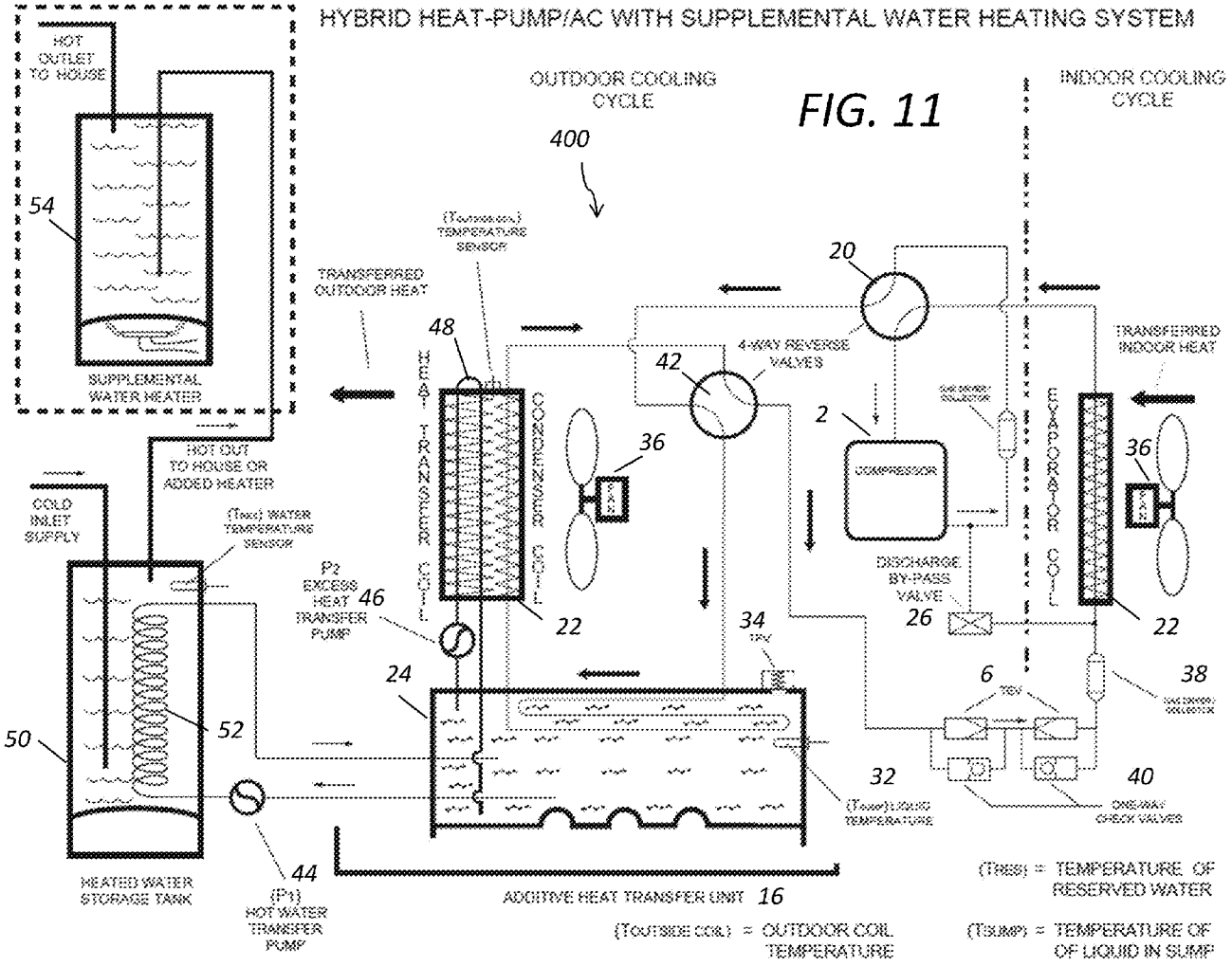
FIG. 11 shows heat pump system of FIG. 8 with an additional water heater.

The heat pump 400 of FIGS. 8-9 is shown connected to an additional water heater 54 in FIG. 11. It will be understood that the heat pump 400 and water heater 50 can be connected to a conventional water heater in a home or other building. The heat pump 400 with water heater 50 can connect and/or interact with the water heater 54 similar to other auxiliary water heater systems such as solar panels and hydrothermal energy used to heat water. The water heater 50 can provide one or more ways to heat the water. For example, the water heater 50 can include a gas heater to heat the water in addition to the coil 52. In some embodiments, the coil 52 is the only heater system within (FIG. 8) or directly connected to (FIG. 10) the water heater 50. The water heater 54 can be a conventional water heater, but it can also be a supplemental water heater, such as an electric water heater at the source of water usage (i.e. under a sink, adjacent a shower, etc.).

Figure 12:
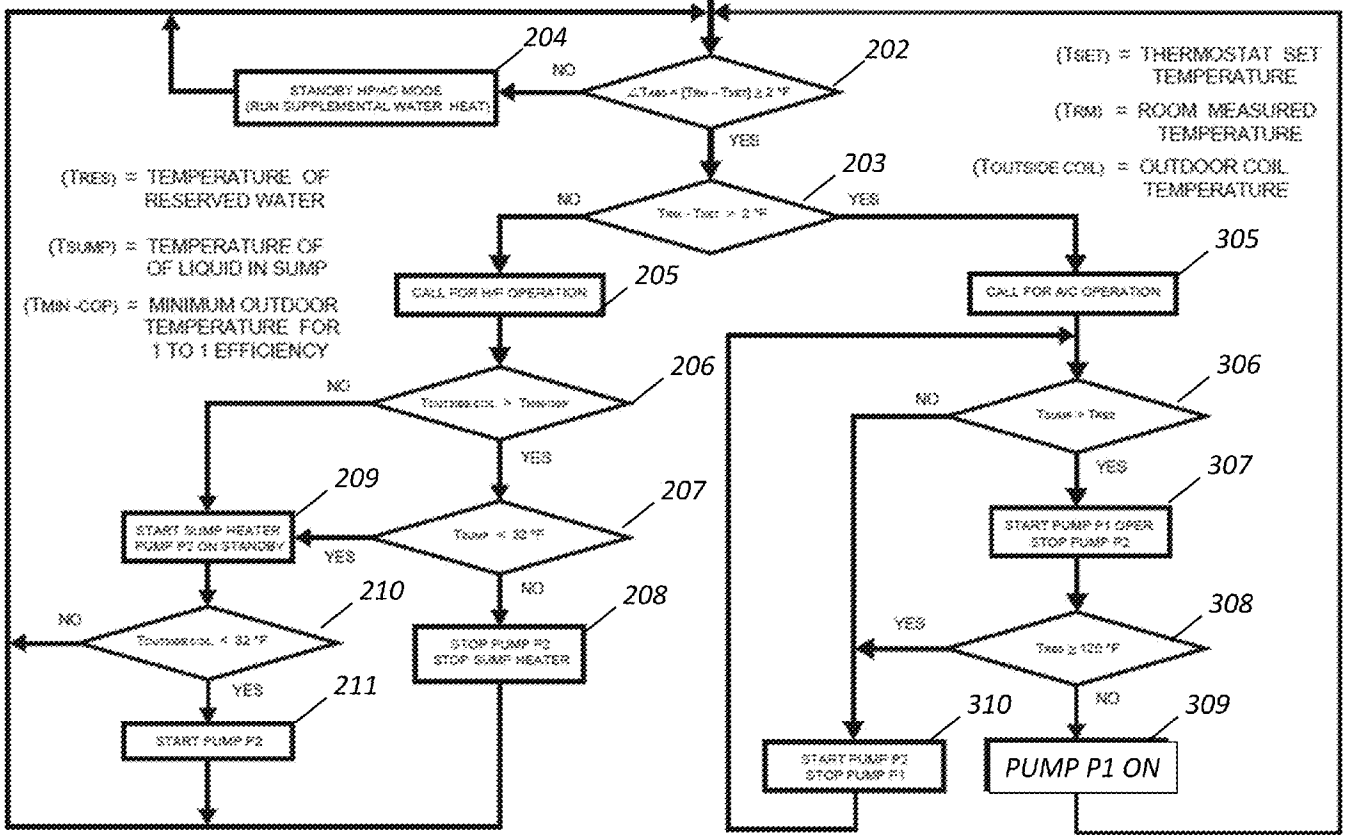
FIG. 12 illustrates a control process flow diagram.

A control process flow diagram is shown in FIG. 12. The illustrated control process flow can be used to control the heat pump 400 with water heaters 50, 54 as shown in FIG. 11. The control process can be used to modulate one or more of the components. For example, the control process flow diagram can modulate fan speed, defrost mode, additive heat, refrigerant flow, refrigerant metering (at the directional by-pass valve or a one-way check valve), supplemental water heating, etc.

The control process can start at 201 with the call for heating or cooling. This can be such as when the system is turned on, and/or when the heater or AC is turned on. The process then moves to 202 wherein one or more ambient temperatures ($T_{RM}$) are compared to a desired temperature ($T_{SET}$) to determine whether a heating or a cooling cycle is warranted. In the illustrated example, heating or cooling would be called for if the difference between the desired temperature and the ambient temperature is greater than or equal to 2 degrees F. Though it will be understood that all of the temperatures listed in the diagram are examples and other temperatures could be used and in some cases the temperatures can be set by a user.

If no heating or cooling is required the system can go into standby mode 204. In standby mode, as the heat pump is not activated the heater in the water heater 54 can be used, as there may not be any excess heat in the additive heat transfer unit 16.

If heating or cooling is required the system will run either a heating operation 205 or a cooling operation 305. The illustrated heating operation will be described first.

In the heating operation the heat pump will run to provide heat inside the building. In addition, a defrost and additive heat routine will run. This will determine whether the heat exchanger is frozen and whether a defrost cycle needs to be run and also whether additive heat should be added to increase the efficiency and effectiveness of the heat pump. At 206 the system will compare the temperature of the outside heat exchanger ($T_{OUTSIDE\ COIL}$) to a preset minimum temperature of the liquid in the additive heat transfer unit 16 for 1 to 1 efficiency ($T_{MIN\text{-}COP}$) also known as the coefficient of performance (COP). If the temperature ($T_{OUSIDE\ COIL}$) is above that temperature ($T_{MIN\text{-}COP}$) it will then move to step 207. Here the actual temperature of the liquid in the additive heat transfer unit 16 ($T_{SUMP}$) is compared to freezing. If the temperature ($T_{SUMP}$) is above freezing neither the defrost cycle nor the additive heat transfer unit need to be run. Thus, if either were running from a previous cycle they are stopped at 208. In other words, with reference to FIG. 11, the pump 46 is turned off and the additive heat transfer unit 16 is also turned off. This is because the system is running at peak efficiency ($T_{MAX\text{-}COP}$).

Returning to step 206, if the temperature of the outside heat exchanger ($T_{OUTSIDE\ COIL}$) is less than the preset minimum 1 to 1 efficiency temperature ($T_{MIN\text{-}COP}$), the additive heat transfer unit 16 will be activated at 209. This is also the result if temperature of the liquid in the additive heat transfer unit 16 ($T_{SUMP}$) is below freezing. The temperature of the heat exchanger ($T_{OUTSIDE\ COIL}$) is checked and compared against freezing to determine whether the pump 46 should be run at 211 to defrost the heat exchanger.

Turning now to the cooling operation 305, in the cooling operation the heat pump will run to provide cooling inside the building. In addition, water heating routine will run. This will determine whether excess heat from the additive heat transfer unit 16 can be used to heat water in the water heater 50 (FIG. 11). At 306 the system will compare the temperature of the liquid in the additive heat transfer unit 16 ($T_{SUMP}$) to that of the water in the water heater 50 ($T_{RES}$). If the liquid in the additive heat transfer unit 16 is hotter than the water in the water heater 50 the pump 44 is turned on to begin transferring heat to the water in the water heater 50. The second pump 46 is also turned off.

The water temperature ($T_{RES}$) is then compared against a set high temperature, (step 308), such as 120 degrees F. This temperature can be the desired maximum hot water temperature. If this temperature has not been reached the pump 44 continues to run (step 309). If the temperature has been reached the pump 44 is turned off and the pump 46 is activated to drain the excess heat to the outside surroundings.

In some embodiments, an air source heat pump HVAC system can have a closed loop flow pathway configured for refrigerant to flow within the closed loop flow pathway. The system can comprise a compressor; an expansion valve; a first air source heat exchanger; a second air source heat exchanger; a reversing valve; an additive heat transfer unit (AHTU); a water heater; a water heater coil; and a heat transfer coil.

The reversing valve having a first position in a cooling mode and a second position in a heating mode, and being configured to change a direction of flow of refrigerant through a closed loop flow pathway in the system such that in the cooling mode the first air source heat exchanger functions as an evaporator and the second air source heat exchanger functions as a condenser, and in a heating mode the first air source heat exchanger functions as a condenser and the second air source heat exchanger functions as an evaporator.

The closed loop flow path defines a refrigerant flow path in a continuous loop, such that when the reversing valve is in the first position in a cool mode, the refrigerant flow path extends from the compressor to the second air source heat exchanger, from the second air source heat exchanger to the expansion valve, from the expansion valve to the first air source heat exchanger, and from the first air source heat exchanger back to the compressor, the refrigerant flow path being reversible when the reversing valve is moved to the second position.

The additive heat transfer unit (AHTU) can comprise a liquid source heat exchanger, wherein the flow of refrigerant passes through the AHTU in both the cooling and heating modes, the AHTU configured to provide additional heat to the refrigerant either before or after the refrigerant flows to the second air source heat exchanger. The water heater coil can be in thermal communication with the water heater and the AHTU and configured such that excess heat from the AHTU can be used to heat water from the water heater. The heat transfer coil can be positioned within the second air source heat exchanger, the heat transfer coil can be configured to such that liquid from the liquid source heat exchanger in the AHTU is directed to the second air source heat exchanger during a defrost cycle during the heating mode.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

Similarly, this method of disclosure, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. An air source heat pump HVAC system, the system having a closed loop flow pathway configured for refrigerant to flow within the closed loop flow pathway, the system comprising:

a compressor;

an expansion valve;

a first air source heat exchanger;

a second air source heat exchanger;

a reversing valve having a first position in a cooling mode and a second position in a heating mode, and being configured to change a direction of flow of refrigerant through a closed loop flow pathway in the system such that in the cooling mode the first air source heat exchanger functions as an evaporator and the second air source heat exchanger functions as a condenser, and in a heating mode the first air source heat exchanger functions as a condenser and the second air source heat exchanger functions as an evaporator;

wherein the closed loop flow path defines a refrigerant flow path in a continuous loop, such that when the reversing valve is in the first position in a cool mode, the refrigerant flow path extends from the compressor to the second air source heat exchanger, from the second air source heat exchanger to the expansion valve, from the expansion valve to the first air source heat exchanger, and from the first air source heat exchanger back to the compressor, the refrigerant flow path being reversible when the reversing valve is moved to the second position;

an additive heat transfer unit (AHTU) comprising:

a liquid source heat exchanger, wherein the flow of refrigerant passes through the AHTU in both the cooling and heating modes, the AHTU configured to provide additional heat to the refrigerant either before or after the refrigerant flows to the second air source heat exchanger;

a water heater;

a water heater coil in thermal communication with the water heater and the AHTU and configured such that excess heat from the AHTU can be used to heat water from the water heater; and a heat transfer coil positioned within the second air source heat exchanger, the heat transfer coil configured to such that liquid from the liquid source heat exchanger in the AHTU is directed to the second air source heat exchanger during a defrost cycle during the heating mode.

2. The system of claim 1, wherein the system consists of two units, one unit being an indoor unit configured for indoor use and the other unit being an outdoor unit configured for outdoor use, the indoor unit comprising the first air source heat exchanger and the outdoor unit comprising the compressor, the second air source unit, and the AHTU.

3. The system of claim 1, wherein each of the heat exchangers comprise a coil configured to receive refrigerant flow and defines the closed loop flow path through the heat exchanger, each heat exchanger configured to heat or cool the refrigerant by flowing a medium of air in the case of the air source heat exchangers or liquid in the case of the liquid source heat exchanger over the coil.

4. The system of claim 1, wherein the water heater coil is positioned within the water heater and the water heater coil being configured such that liquid from the liquid source heat exchanger in the AHTU is directed to the water heater during an excess heat water heater mode.

5. The system of claim 1, wherein the water heater coil is positioned within the AHTU and the water heater coil being configured such that potable water from the water heater is directed to the AHTU during an excess heat water heater mode.

6. The system of claim 1, wherein the water heater comprises a first and a second water heater, the second water heater having a gas heater configured to heat the water received from the first water heater.

7. The system of claim 1, wherein the reversing valve comprises a first reversing valve and a second reversing valve, the first reversing valve configured to control flow to and from the compressor and the second reversing valve configured to control flow to and from the expansion valve.

* * * * *